United States Patent [19]

Ausnit

[11] Patent Number: 4,850,178

[45] Date of Patent: Jul. 25, 1989

[54] DEVICE FOR OPENING A DOUBLE LINK BAG CHAIN

[75] Inventor: Steven Ausnit, New York, N.Y.

[73] Assignee: Minigrip, Inc., Orangeburg, N.Y.

[21] Appl. No.: 214,547

[22] Filed: Jul. 1, 1988

[51] Int. Cl.[4] ..... B65B 43/28; B65B 43/34

[52] U.S. Cl. ..... 53/570; 53/202; 53/384; 53/390

[58] Field of Search ..... 53/570, 384, 390, 202, 53/459, 468

[56] References Cited

U.S. PATENT DOCUMENTS

| | | | |
|---|---|---|---|
| 2,671,587 | 3/1954 | Vogt | 53/570 X |
| 2,671,588 | 3/1954 | Vogt | 53/570 X |
| 3,599,388 | 8/1971 | Feingold | 53/570 X |
| 3,744,211 | 7/1973 | Titchenal et al. | 53/570 X |
| 3,817,017 | 6/1974 | Titchenal | 53/459 X |
| 4,514,962 | 5/1985 | Ausnit | 53/384 X |
| 4,586,319 | 5/1986 | Ausnit | 53/384 X |
| 4,654,878 | 3/1987 | Lems | 53/459 X |
| 4,665,522 | 5/1987 | Lems et al. | 53/384 X |

*Primary Examiner*—Horace M. Culver

[57] ABSTRACT

An apparatus for opening dual bag sets having pressure interlocking zipper profiles along the top with pull flanges extending upwardly from the profiles and a bridging pull flange joining adjacent bag pairs, dual flange gripping means for the outer pull flanges of each of the bags riding along a rib on the bag, with the gripping means mounted on pivotal handles so that after the bags are moved forwardly, they can be pulled open for filling by manually pressing the handles together with the handles provided with a return spring.

16 Claims, 2 Drawing Sheets

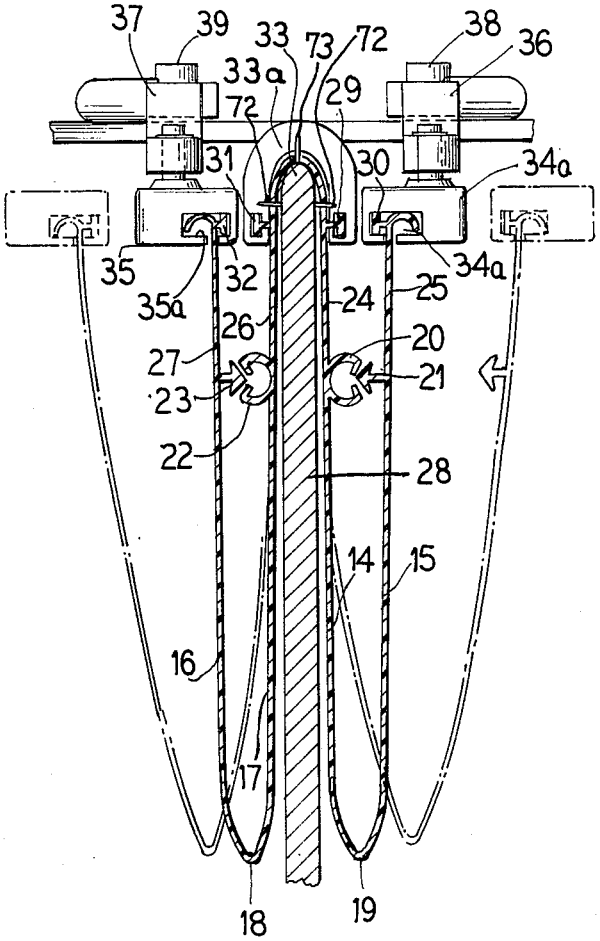
FIG. 3
FIG. 4
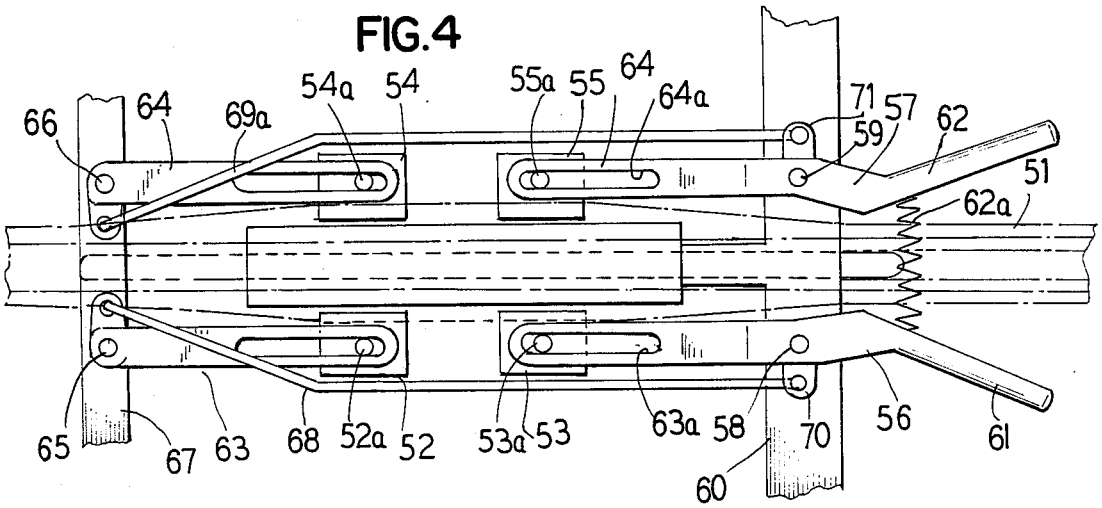

DEVICE FOR OPENING A DOUBLE LINK BAG CHAIN

BACKGROUND OF THE INVENTION

This invention relates to apparatus for opening and filling zipper equipped bags and is particularly concerned with bags which are serially connected together and arranged in pairs. Structures have heretofore been provided for the opening and filling of zipper equipped chain bags such as that disclosed in U.S. Pat. No. 4,490,959 dated Jan. 1, 1985, issued to Peter Lems, and U.S. Pat. No. 4,665,552 issued May 12, 1987 to Peter Lems et al.

For the rapid handling of bags, bag structures have been arranged interconnected in series and additionally arranged in pairs so that the series of bags has laterally located side-by-side bags that can be opened, filled and closed at the same time to increase productivity.

It is often necessary in the handling of such bags to fill them in relatively short runs which does not merit expensive automatic equipment but requires equipment which can be used manually. Such equipment must insure simplified handling of the bags in a manner which does not require a lot of time for loading and filling but which is reliable and permits a bag chain of dual bags to be moved forward and simultaneously opened so that they can be filled at the same time and thereafter closed.

SUMMARY OF THE PRESENT INVENTION

Accordingly, it is an object of the present invention to provide improved equipment which is capable of opening and filling zipper closed bags of a continuous bag chain wherein the bags are arranged in interconnected pairs.

A further object of the invention is to provide a new improved and simplified manually operated structure for opening and filling a series of zipper closed plastic bags.

A further object of the invention is to provide a new and improved apparatus for opening and filling pairs of serially arranged zipper closed bags wherein the equipment has improved features over those heretofore available and is readily adapted to use with bags of different sizes.

The present invention provides for the handling, opening and filling of dual bags arranged in serially interconnected chains. Such bag constructions are formed of thin plastic film with sidewall panels that have continuous rib and groove pressure interlockable profiled zippers at the top. In operation the dual bags are supported being interconnected in chains and are pulled open so that contents can be loaded in the top and the bags thereafter immediately closed by pressing the zippers together. The bags are received from a bag supply which is initially manufactured with the zippers interlocked and the continuous bags rolled on supply rolls so that they can be serially pulled off of the supply rolls.

For convenience in filling, and for easy handling and control of the bags, bridging pull flanges between the dual bags are draped over a smooth continuous ridge. A manually operable opening device is provided which has unique features in that it has a pair of pivotal arms which act in scissors fashion to be manually operated with handles which are pressed together to effectively open the tops of the dual bags with the handles being releasable so that the bags can be closed. If desired, the system can also be automated.

The bag opening structure has blocks which grip the outer flanges of the dual bags. For this purpose, the flanges have raised ridges therealong which slide in grooves in the opening blocks. In one form dual opening blocks are provided spread apart so that a broad portion of the bag is opened. The opening blocks are moved outwardly by pressing the handles together, to open the bag. By pulling apart on the outer flanges, the rib and groove interlocking zipper elements are forced to separate to open the bag. The opening blocks hold the bags open so that they can be readily filled. The opening blocks are then moved back together and the dual bag chain is moved forward and pressure rollers reinterlock the two sets of rib and groove elements, the contents now having been placed into the bags through the open tops.

The invention also provides for a unique manual opening structure which is continually in place on the bag so that merely pressing handles together will pull the bag tops to open position, and releasing the handles will permit the rib and groove elements to be again pressure interlocked.

Other objects, features and advantages of the invention will be more readily apparent from the teaching of the principles thereof in connection with the disclosure of the preferred embodiments in the specification, claims and drawings, in which:

DESCRIPTION OF THE DRAWINGS

FIG. 3 is a vertical sectional view taken substantially along line III—III of FIG. 1; and FIG. 4 is a top plan view illustrating a modified form of structure embodying the principles of the invention.

DETAILED DESCRIPTION

Figure 1:
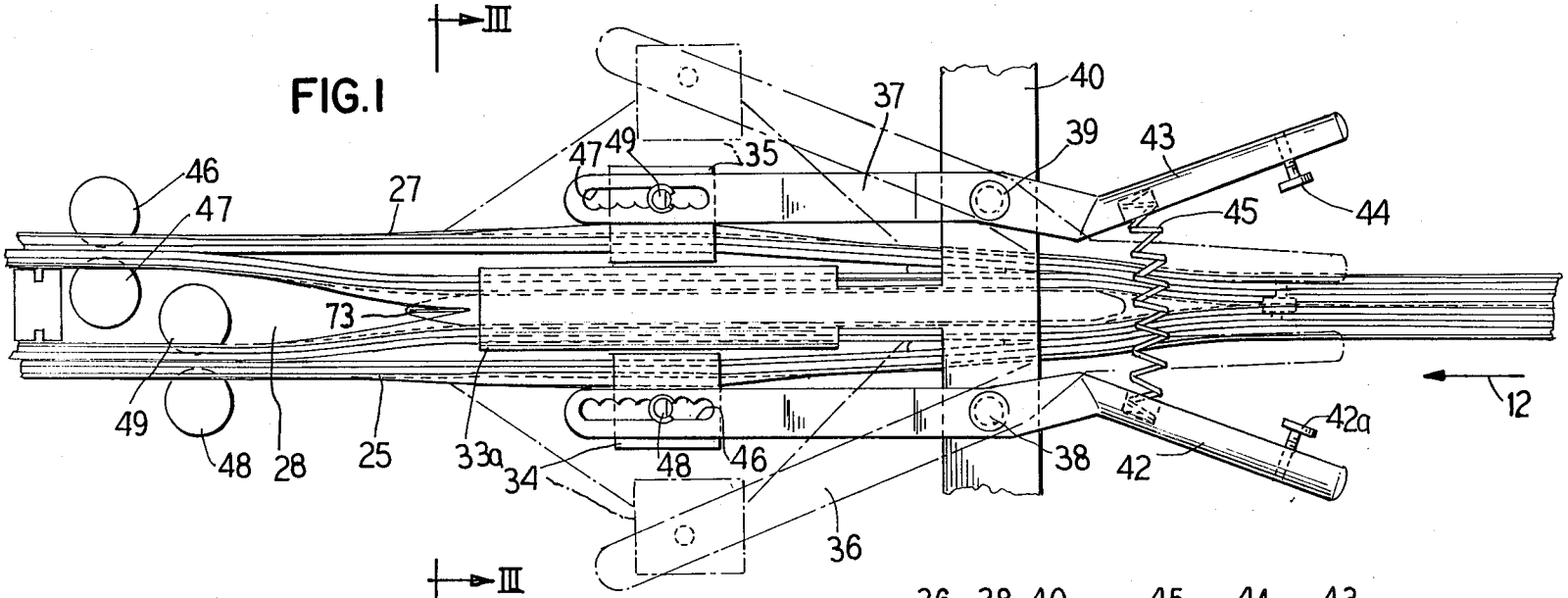
FIG. 1 is a top plan view of the structure of apparatus embodying the principles of the present invention shown in place operating on a chain of continuous dual bags.
Figure 2:
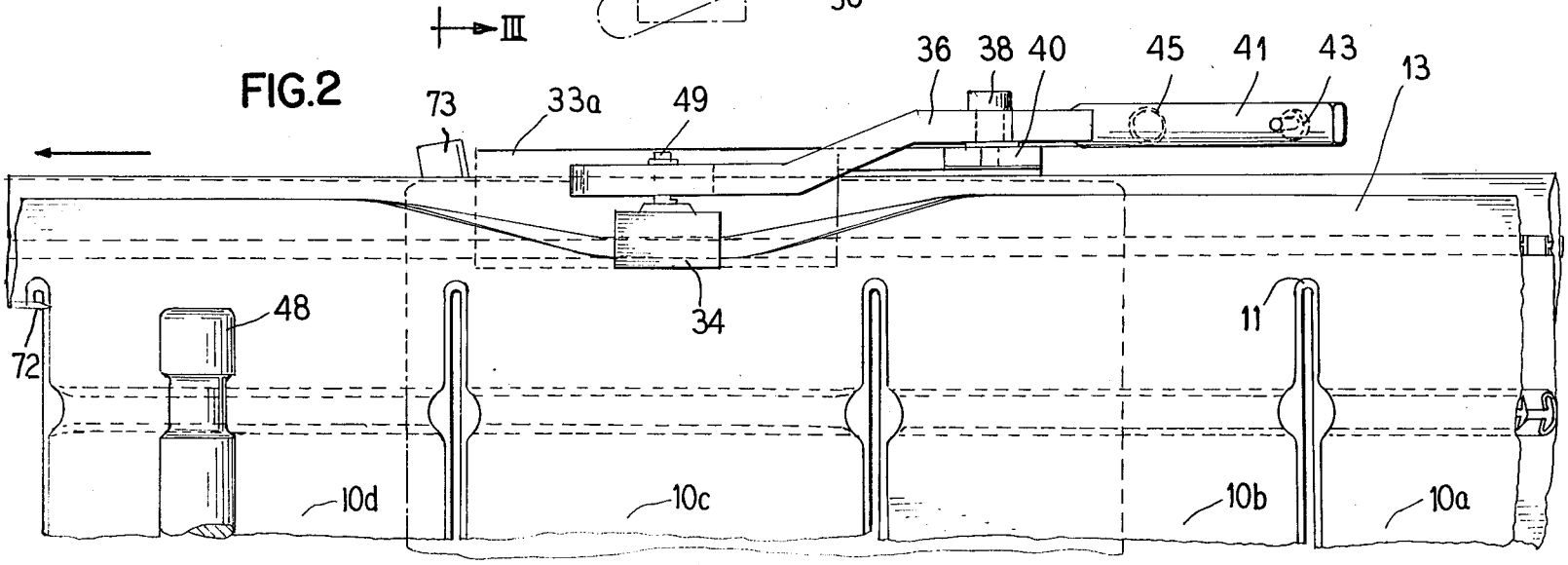
FIG. 2 is a fragmentary side elevational view illustrating the tops of the bags of FIG. 1.

As illustrated in FIGS. 1 through 3, a chain of dual bags, shown by exemplary sequential bags 10*a*, 10*b*, 10*c* and 10*d* in FIG. 2 are separated from each other by slots 11 and are connected at their top ends by saddle strip 13. The interconnected chain consisting of double bags in side-by-side relationship is pulled forwardly through the structure being supported on a vertical ridge 33, FIG. 3.

The bags are shown in greater detail in FIG. 3 as draped over the ridge 33. The right bag 19 has side panels 14 and 15 and the left bag 18 has side panels 16 and 17. On the inner surfaces of the bag side panels are profiled zipper rib and groove fastener elements which interlock when pressed together and separate when pulled apart from outside the bag by pulling laterally on pull flanges. The fastener elements for the bag 19 are shown by the groove element 20 shaped and sized to lockingly receive an arrowhead profile element 21.

Similarly for the bag 18, on the inner surface of the side panels, are fastener zipper elements shown by a groove element 22 and a rib element 23 with the rib and groove elements complementary shaped to interlock when pressed together. When the bags are originally manufactured in a chain, the ribs and grooves are interlocked for storage and stacking, and the chain of bags will be removed from a supply roll or storage container to be fed over the supporting ridge 33.

Extending above the rib and groove elements are pull flanges such as 24 and 25 for the bag 19 and 26 and 27 for the bag 18. The pull flanges 24 and 26 between the bags are interconnected to provide a supporting bridge 28 which drapes over the ridge 33 to support the bags. Because the inner pull flanges 24 and 26 are interconnected at the bridge 28 and held in place by arch 33*a*, when the outer pull flanges 25 and 27 are pulled outwardly, the ribs 21 and 23 are forcibly pulled out of the grooves to open the bags at the top so that they can be filled. The open position is shown in the dotted line position of FIG. 3.

The pull flanges have guide and support ribs on their inner faces, as illustrated by the ribs 29 and 30 for the pull flanges 24 and 25. Guide and support ribs 31 and 32 are provided for the other bag on the pull flanges 26 and 27. These guide and support ribs provide a means for a structure to grip and hold the pull flanges and to pull them laterally apart, as indicated.

The inner pull flanges 24 and 26 have support ribs 29 and 31 respectively.

Spaced above the support ridge 33 is a continuous arch 33*a* which has grooves shaped to receive the support ribs 29 and 31. While the ridge 33 provides the support for the dual bags, the grooves of the arch 33*a* hold in place the upper pull flanges of the inner panels of the bags when the outer pull flanges are pulled outwardly.

The outer pull flanges of the bags, namely flanges 25 and 27 have, as indicated, support ribs 30 and 32. These ribs are held in grooves in gripping blocks 34 and 35. The grooves are shown at 34*a* and 35*a* and are shaped and sized to hold and receive the support ribs 30 and 32, and such small additional film strip above the rib as might be left over.

The gripping blocks are supported on one end of pivotal arms 36 and 37, FIGS. 1 through 3.

The pivotal arms are supported on a frame piece 40 and are pivoted at 38 and 39. At the other end of the pivotal arms are manually operable handles 42 and 43. Pushing these handles 42 and 43 inwardly toward each other will move the other end of the pivotal arms outwardly to the dotted line position as shown in FIG. 1. This will carry the gripping blocks outwardly to pull the outer pull flanges 25 and 27 of the bags outwardly to separate the rib and groove profiles and open the bags for filling.

The handles 42 and 43 have stops 42*a* and 44 which limit the movement of the handles toward each other and thereby limit the pivotal movement of the arms 36 and 37 so that the pull flanges are pulled outwardly sufficiently far to open the bags but no further. The stops 42*a* and 44 engage each other to stop movement of the handles when the handles are pushed fully toward each other, and for this purpose, the stops 42*a* and 44 may be threaded into the handles so as to be adjustable.

The handles are pushed together to spread the arms 36 and 37, but when the handles are released, a coil compression spring 45 pushes the handles back apart so that the normal position of the arms and the pull flanges of the bags are in the solid line position, shown in FIG. 1. This is the way the bags are received when the bag chain is advanced in the direction shown by the arrowed line 12 in FIG. 1.

After the bags have been pulled open, filled, and returned to their in-line position and the bag chain is moved forwardly, pressure rollers reclose the rib and groove elements pressing them together into engagement. For this purpose, pressure rollers 46 and 47 are shown for one of the bags, and 48 and 49 for the other bag. Alternately, one common pressure roller may be used in the central location replacing inside rollers 47 and 49.

The gripping blocks 34 and 35 for pulling the bags open are adjustable. As the blocks are moved outwardly on the arms, this will cause them to be spread apart further when the handles are pushed together. Similarly, moving the blocks inwardly on the arms will cause them to be moved apart less far when the handles are pushed together. Various convenient mechanical linkages may be employed to adjustably move the position of the gripping blocks along the arms, and as illustrated the arms have longitudinal slots 46 and 47 which are flat along one side and have arcuate recesses along the other side. The blocks have support pins 48 and 49 and the pins have rotatable elements which are flat on one side and arcuate on the other side so that they can be rotated to a release position for adjustment of the blocks and again rotated to lock the blocks in their chosen adjusted position.

In some instances it may be desirable to provide a wider opening for the bag tops or to provide a rectangular opening because of the objects to be placed in the bags. For this purpose, the gripping blocks may be arranged so that dual blocks for each of the pull flanges are provided. This is shown in detail in FIG. 4 wherein first and second gripping blocks 52 and 53 for receiving and holding the pull flange on one side of the bags are provided. Similarly, first and second blocks 54 and 55 are provided to grip and pull the flange for the bag at the other side of the chain. The gripping blocks are each provided with grooves to receive and hold the pull flanges at the outer panel of the bags.

The gripping blocks are operated by pivotal arms 56 and 57, which are pivoted at 58 and 59 on a frame piece 70. At one end of the arms, the blocks 53 and 55 are supported such as by vertical pins 53*a* and 55*a* projecting up into slots 63*a* and 64*a* in the arms. The pins 53*a* and 55*a* may have means for locking them in their chosen location along slots or they may be slidable therein.

The pivotal arms 56 and 57 have handles 61 and 62 at the ends opposite the gripping block. A coil compression spring 62*a* urges the handles apart to bring the gripping blocks together to the position shown in FIG. 4. Pushing the handles 61 and 62 together will push the gripping blocks outwardly to pull the pull flanges outwardly and thereby open the bags.

To provide for operating mechanism for the other spaced gripping blocks 52 and 54, these gripping blocks are supported on bell cranks 63 and 64. The gripping blocks 52 and 54 are supported on vertical pins 52*a* and 54*a* extending into slots on the long arm of the bell cranks 63 and 64. The bell cranks are pivoted at 65 and 66 on a frame member 67. The bell cranks shorter arms are in turn connected to pull rods 68 and 69 which connect to lateral arms 70 and 71 on the pivotal arms 56 and 57. Thus, when the arms 56 and 57 are pivoted by pushing the handles together, the rods 68 and 69 will pull on the bell cranks to move the gripping blocks 52 and 54 outwardly the same distance and at the same time as the spaced gripping blocks 53 and 55.

Thus, it will be seen in operation in connection with the arrangement of FIG. 4, that as the handles 61 and 62 are pushed together manually, the spaced gripping blocks 52 and 53 for the outer bag at one side of the chain move outwardly to pull the pull flange of the bag outwardly and pull the profiles of the fastener apart. At the same time, the gripping blocks 54 and 55 at the outer pull flange of the inner or other bag are moved outwardly to open the inner bag. Thus, a sizable opening at the top of each of the bags is created and they can be filled with larger objects. The handles are then released so that the bag chain can be moved forwardly, and the zipper profiles again pressed together to close the bag. This operation is done successively as each set of bags in the chain is moved into position at the opening and filling station which is shown at the center in FIG. 4.

The same concepts and same type of mechanism may be utilized in the opening of two separate bags at the same time with the gripping blocks spaced so that they match the spacing of their adjacent bags.

In operation with the mechanism of FIGS. 1 through 3, the chain of bags is incrementally pulled forward, preferably manually, in the direction shown by the arrowed line 12. Each time a set of bags is moved into the filling station which is directly below the arch 33*a*, the arms 36 and 37 are pivoted by pressing the handles 42 and 43 inwardly. This pulls the grippings blocks 34 and 35 outwardly to pull the bags open and to hold them open so that contents can be filled into the top of the bags. The bag chain is then incrementally pulled forwardly so that the rib and groove zipper elements are pulled through the closing rollers 46 and 47 and 48 and 49. The thus filled bags are then separately cut off of the chain by horizontal blades 72, set into the supporting bridges 28. Alternately, if two sets of joined filled bags are desired, a single vertical blade 73 is placed in either bridge 28 or in arch 33*a*.

Thus, it will be seen that the mechanism provides a structure which is relatively inexpensive to manufacture and which a user who purchases chains of bags can have at his location. The chain is easily loaded into the mechanism by pulling the chain of bags over the supporting ridge with the flanges slid into the gripping blocks. In this manner, a run can be made opening, filling and closing as many bags as needed. If the process calls for filling bags of different sizes, the user can have supply rolls of bags of different size and use this same mechanism for varying bags for quick fill runs utilizing reliable direct operating and inexpensive mechanism. The structure is reliable and particularly well adapted to handle reclosable bags of thin plastic film. While the mechanism is operated manually, it will be observed that the structure functions to support the chain of bags and to open and hold it for filling, as well as to close the chain. Contrasting this with the necessary operations for otherwise manually pulling the bags open between the thumb and forefinger, the mechanism provides for an operation speeded up manyfold over the simple manual handling of bags, especially in view of the mechanism's ability to handle a double chain of interconnected bags. While the mechanism is designed for manual operation it can readily be automated.

I claim as my invention:

1. An apparatus for opening and filling adjoining plastic bags having pressure interlocking zipper profiles along the top with pull flanges extending upwardly from the profiles and bridging flanges joining adjacent bags comprising in combination:

flange gripping first means for gripping the outer pull flange of a closed zipper bag having a second bag connected thereto by a bridging flange;

second means for gripping the outer pull flange of the second bag so that the bags can be opened by a lateral separation of said first and second means;

pivot arms with said first means on one arm and the second means on the other arm; and a manually operated handle means connected to the arms so that movement of the handle will move the first means away from the second means to open the bags.

2. An apparatus for opening and filling adjoining plastic bags having pressure interlocking zipper profiles along the top with pull flanges extending upwardly from the profiles and bridging flanges joining adjacent bags constructed in accordance with claim 1:

including an elongate ridge for supporting the bridging flange between the interconnected bags.

3. An apparatus for opening and filling sets of interconnected plastic bags having pressure interlocking zipper profiles along the top with said bags arranged in double form with a center pull flange interconnecting first and second bag sets and outer pull flanges extending upwardly from the profiles comprising in combination:

first and second flange gripping means for respectively receiving the outer pull flange of said first and second bags;

a continuous ridge for supporting a doubled bridging flange between said bags;

pivotal arms supporting said first and second means at one side of the pivot; and manually operable handle means at the other side of said pivot so that said means can be simultaneously moved outwardly to open both of said bags for simultaneous filling.

4. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

wherein said first and second gripping means are longitudinally adjustable to accommodate gripping flanges of bags at different locations for different sized bags.

5. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

wherein said first and second means are supported on blocks having means connecting the blocks to the arms and for adjusting the blocks linearly relative to the pivot point of the arms.

6. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

including spring return means for the handle means for urging the handles in a direction to move said first and second means together.

7. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

wherein said first and second means are provided with longitudinal grooves for receiving supporting ridges on the pull flanges of the bags.

8. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

including means for limiting pivotal movement of the arms.

9. An apparatus for opening and filling sets of interconnected plastic bags having pressure interlocking zipper profiles along the top with said bags arranged in double form with a center pull flange interconnecting first and second bag sets and outer pull flanges extending upwardly from the profiles constructed in accordance with claim 3:

including pressure closing rollers positioned for pressing zipper profiles together after the bags have been opened by said first and second means.

10. An apparatus for opening and filling adjacent interconnected plastic bags having interlocking zipper profiles along the bag tops with pull flanges extending upwardly from the profiles and a bridging flange interconnecting the bags comprising in combination:

a continuous supporting ridge for supporting the bridging flange between adjacent bags so that continuous bags can be drawn linearly therealong;

first and second flange gripping means for receiving the outer pull flanges of each of the bags;

movable arms each supporting the gripping means; and handle means connected to said movable arms for moving the gripping means between a first position adjacent each other and a spread position for drawing bag tops apart.

11. An apparatus for opening and filling sets of interconnected plastic bags having interlocking zipper profiles along the bag tops with pull flanges extending upwardly from the profiles and a bridging flange interconnecting the bags constructed in accordance with claim 10:

wherein said gripping means have linear recesses for receiving ribs on the bags.

12. An apparatus for opening and filling sets of interconnected plastic bags having interlocking zipper profiles along the bag tops with pull flanges extending upwardly from the profiles and a bridging flange interconnecting the bags constructed in accordance with claim 10:

wherein each of said first and second gripping means have separated elements so that the bag tops are opened at spaced locations.

13. An apparatus for opening and filling sets of interconnected plastic bags having interlocking zipper profiles along the bag tops with pull flanges extending upwardly from the profiles and a bridging flange interconnecting the bags constructed in accordance with claim 10:

wherein said ridge has inner flange gripping means for gripping the inner bridging flange between adjacent bags.

14. An apparatus for opening and filling sets of interconnected plastic bags having pressure interlocking zipper profiles along the top with pull flanges extending upwardly from the profiles and a bridging flange connecting dual bag sets and provided with ribs along the pull flanges comprising in combination:

a continuous ridge having a smooth top for supporting the bridging flanges of interconnected bags;

flange gripping first and second means gripping the outer flanges of each of the bags with each of said gripping means having spaced flange engaging members for opening a broad portion of the bag top;

pivotal handles with gripping means at one end and a handle at the other end for manually moving the gripping means apart; and spring means connected to said handles for urging the gripping means together.

15. An apparatus for opening and filling adjacent interconnected plastic bags having interlocking zipper profiles along the bag tops with pull flanges extending upwardly from the profiles and a bridging flange interconnecting the bags comprising in combination:

a continuous supporting ridge for supporting the bridging flange between adjacent bags so that continuous bags can be drawn linearly therealong;

first and second flange gripping means for receiving the outer pull flanges of each of the bags;

an arch above the supporting ridge holding said bridging flange in place on the continuous ridge; and first and second outer flange gripping means for receiving the outer pull flanges of each of the bags and drawing them outwardly to open the bags carried on the continuous ridge;

said flange gripping means being carried on pivotally movable arms supported on said arch.

16. An apparatus for opening and filling sets of interconnected plastic bags having interlocking zipper profiles along the bag tops with pull flanges extending upwardly from the profiles and a bridging flange interconnecting the bags constructed in accordance with claim 15:

wherein said pivotal arms are operated by manual handle means to move the movable arms so that the gripping means move between a first position adjacent each other and a spread position for opening the bag tops.

* * * * *